US008007349B2

(12) United States Patent
Turnbull

(10) Patent No.: US 8,007,349 B2
(45) Date of Patent: Aug. 30, 2011

(54) DUAL SURFACE SANDING BLOCK

(75) Inventor: Clifford W. Turnbull, Kent, WA (US)

(73) Assignee: Trade Associates, Inc., Kent, WA (US)

( * ) Notice: Subject to any disclaimer, the term of this patent is extended or adjusted under 35 U.S.C. 154(b) by 0 days.

(21) Appl. No.: 11/960,604

(22) Filed: Dec. 19, 2007

(65) Prior Publication Data

US 2009/0163123 A1 Jun. 25, 2009

(51) Int. Cl.
*B24D 15/00* (2006.01)

(52) U.S. Cl. ..... 451/523

(58) Field of Classification Search ..... 451/523
See application file for complete search history.

(56) References Cited

U.S. PATENT DOCUMENTS

| | | | | | |
|---|---|---|---|---|---|
| 2,018,611 | A | * | 10/1935 | Feuerstein | 451/491 |
| 2,550,393 | A | * | 4/1951 | Wurfschmit | 451/491 |
| 2,626,489 | A | * | 1/1953 | Thompson | 451/491 |
| 2,756,549 | A | * | 7/1956 | Macullar | 451/491 |
| 3,106,806 | A | * | 10/1963 | Hutchins | 451/504 |
| 3,557,496 | A | * | 1/1971 | Martin | 451/533 |
| 4,887,396 | A | * | 12/1989 | Lukianoff | 451/523 |
| 5,007,483 | A | * | 4/1991 | McGuire | 451/523 |
| 5,168,663 | A | * | 12/1992 | Klocke | 451/523 |
| 5,203,123 | A | * | 4/1993 | Travis | 451/490 |
| 6,544,113 | B1 | * | 4/2003 | Wheeler | 451/495 |
| 6,663,479 | B2 | * | 12/2003 | Sendelbeck | 451/523 |
| 6,852,021 | B1 | * | 2/2005 | Ali et al. | 451/533 |
| 2002/0173258 | A1 | * | 11/2002 | Biddle et al. | 451/490 |

FOREIGN PATENT DOCUMENTS

| | | | |
|---|---|---|---|
| JP | 10-235565 | A | 9/1998 |
| JP | 2002-239928 | A | 8/2002 |
| JP | 2003-275967 | A | 9/2003 |

* cited by examiner

*Primary Examiner* — Maurina Rachuba
(74) *Attorney, Agent, or Firm* — Dorsey & Whitney LLP

(57) ABSTRACT

A sanding block is disclosed having an elongate shape having a constant cross section along most of its longitudinal axis. The sanding block is formed of a flexible material and has a curved upper surface and a flat lower surface. The curved upper surface has a width less than that of the flat lower surface but has an arc length about equal to the width of the flat lower surface. The sanding block is used by securing strips of sand paper to one or both of the upper and lower surfaces. The width of the lower surface and the arc length of the upper surface are preferably chosen to be about equal to the width of the sandpaper.

19 Claims, 2 Drawing Sheets

DUAL SURFACE SANDING BLOCK

TECHNICAL FIELD

This invention relates to sanding blocks.

BACKGROUND OF THE INVENTION

When performing repairs to an exterior of an automobile, surfaces must be carefully prepared to receive paint in order to avoid imperfections. Dents in body panels of an automobile are often repaired by filling them with a paste that subsequently hardens. The paste is then sanded to approximate the original contours of the body panel.

Body panels of automobiles can have a wide variety of shapes given the many models of modern and classic cars that exist. Sanding some body panels having complex contours in order to provide the proper shape and smoothness can be extremely difficult.

Sanding blocks are typically made to be used with industry standard straight line sanding paper, which has a width of 2.75 inches. The sanding paper may be attached to the sanding block by adhesion, Velcro® or other similar temporary attachment methods. Typically, sanding blocks are made so that the industry standard sandpaper fits onto the sanding block without having to cut the width of the paper. For instance, sanding blocks typically have a width of approximately 2.75 inches in order to accommodate the industry standard sandpaper.

One common sanding device is a wood block having a piece of sandpaper wrapped about its exterior. The wood blocks have flat surfaces and work well for sanding flat surfaces, however, they do not work particularly well for curved surfaces. The use of such common sanding blocks on curved surfaces often results in uneven sanding; mainly because such blocks are not bendable to the curvature of the surface being sanded, and because excessive pressure is often applied to some portions of the surface being sanded. Moreover, the application of excessive pressure may result in over sanding and rapid deterioration of the sandpaper, which, in turn, may damage the underlying surface.

In order to accommodate curved surfaces, sanding devices with a curved radius, typically a convex shape curve, are currently being used. The convex shaped blocks may be made from wood or a resilient material such as rubber. A user must use two separate blocks when sanding a surface that has both curves and flat areas, a first rectangular block for sanding flat surfaces and a second curved sanding device for sanding curved surfaces.

Recently, single blocks have been used that have one surface with a curved radius and another surface with a flat surface. However, this requires the sandpaper to be trimmed so that it fits both surfaces. This makes the single block difficult to use since a user would have to cut the standard sized sandpaper each time they wanted to replace the sandpaper on the block.

Therefore, there is need for a single sanding block that can be used to sand flat surfaces and curved surfaces without requiring a user to cut or modify the industry standard sized sandpaper to fit both surfaces of the sanding block.

SUMMARY OF THE INVENTION

In one aspect of the invention, a sanding block formed of a flexible material has a constant cross section along its longitudinal axis. The sanding block has a flat lower surface and a curved upper surface, the curved upper surface having an arc length about equal to the width of the flat lower surface. The width of the curved upper surface is preferably less than the width of the flat lower surface. The width and arc length are chosen to be about equal to standardized sizes for strips of sandpaper.

In use, sheets of sandpaper are secured to one or both of the flat lower surface and curved upper surface. Concave surfaces and convex surfaces having large radii of curvature may advantageously be sanded using the flat lower surface by bending the sanding block to conform to the surface. Concave surfaces having small radii of curvature may advantageously be sanded using the curved upper surface.

DETAILED DESCRIPTION OF PREFERRED EMBODIMENTS

Embodiments of the present invention are directed toward providing a sanding block and a method of using the sanding block. Certain details are set forth below to provide a sufficient understanding of the invention. However, it will be clear to one skilled in the art that the invention may be practiced without these particular details.

Figure 1:
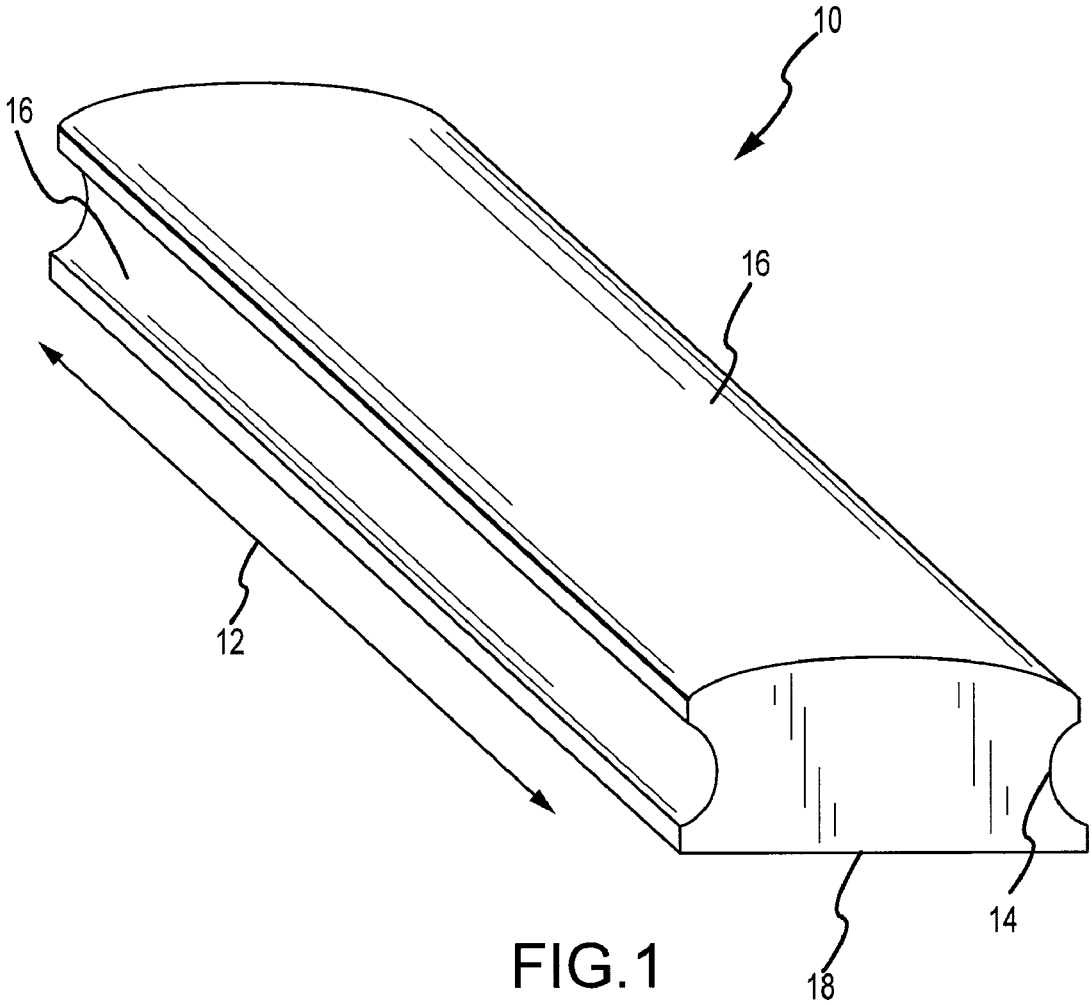
FIG. 1 is an isometric view of a sanding block in accordance with an embodiment of the present invention.

Referring to FIG. 1, a sanding block 10 in accordance with an embodiment of the invention has a constant cross section along a longitudinal direction 12. The sanding block 10 may have a length along the longitudinal direction that is much greater than its width or height perpendicular to the longitudinal direction. In some embodiments, the length of the sanding block 10 along the longitudinal direction 12 is greater than about two times the greatest extent of the sanding block 10 in a direction perpendicular to the longitudinal direction 12, including the width and height. In one embodiment, the sanding block 10 has a length along the longitudinal direction 12 that is greater than about three times, preferably greater than between five and eight times, the greatest extent of the sanding block 10 in a direction perpendicular to the longitudinal direction 12, including the width and height of the sanding block 10. In some embodiments, a longitudinal groove 14 extends along one or both sides of the sanding block 10 parallel to the longitudinal direction 12 to facilitate gripping by a user.

Figure 2:
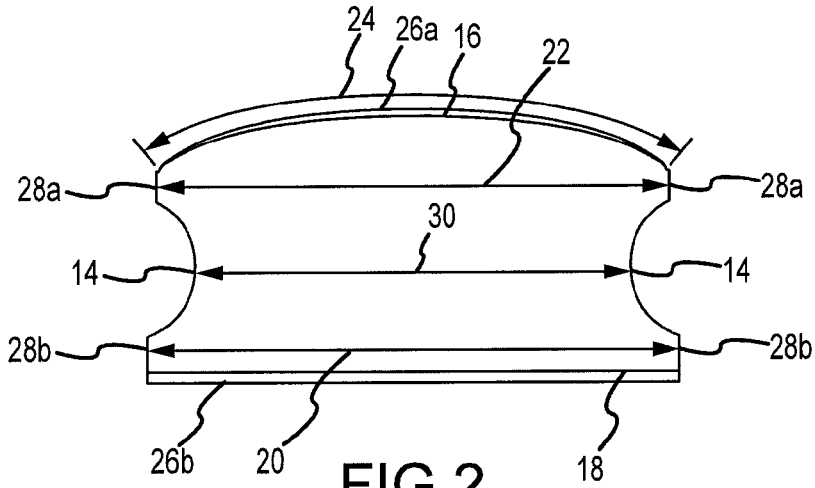
FIG. 2 is a front view of a sanding block in accordance with an embodiment of the present invention.

Referring to FIG. 2, while still referring to FIG. 1, an upper surface 16 of the sanding block 10 is curved whereas a lower surface 18 is flat. The lower surface 18 has a width 20 in a direction perpendicular to the longitudinal direction 12 that is greater than a width 22 of the upper surface 16. However, an arc length 24 of the upper surface 16 is preferably about the same as the width 20 of the lower surface 18. The narrower width 22 of the upper surface 16 corresponds to the narrowing necessary to cause the curved upper surface to have an arc length 24 about equal to the width 20 of the lower surface notwithstanding its curved shape. In some embodiments, the arc length 24 varies from the width 20 by less than five percent of the width 20, preferably less than two percent of the width 20.

As is apparent in FIG. 2, the radius of curvature of the curved upper surface 16 may vary with distance from the center of the sanding block. The radius of curvature preferably decreases with distance from the center. The varying radius of curvature may advantageously facilitate sanding of concave surfaces having a range of radii of curvature.

Sheets 26*a*, 26*b* of sandpaper can be secured to one or both of the curved upper surface 16 and flat lower surface 18. The sheets 26*a*, 26*b* preferably have a width about equal to the width 20. Furthermore, the width 20 of the flat lower surface 18 and the arc length 24 of the curved upper surface 16 may be chosen to correspond to standard sizes for sheets of sandpaper so that the sandpaper covers both surfaces 16, 18 to the edges. For example, in one embodiment a width of 2.75 inches corresponds to the standard width for strips of sandpaper sold in rolls. The width 20 and arc length 24 are preferably approximately equal to the width of the sheets 26*a*, 26*b*. In another embodiment, the width 20 and the arc length 24 are slightly smaller or slightly larger than the width of the sheets 26*a*, 26*b*. For example, the width 20 and arc length 24 may be less than the nominal width of the sheets 26*a*, 26*b* or exceed the nominal width by up to five percent of the nominal width. For example, the width 20 and arc length 24 may be less than the nominal width of the sheets 26*a*, 26*b* or exceed the nominal width by up to two percent of the nominal width.

The curved upper surface 16 and flat lower surface 18 are distanced from one another to provide a mass of material therebetween to be gripped by a user and to make the sanding block 10 somewhat rigid even though it is preferably formed of a flexible material. In one embodiment, the curved upper surface 16 and flat lower surface are separated from one another along their entire widths by an amount at least as great as one fourth of the width 20 of the flat lower surface 18, preferably greater than one third of the width 20. As noted above, longitudinal grooves 14 may be formed between the curved upper surface 16 and the flat lower surface 18. The grooves 14 may be formed between upper lateral wall portions 28*a* and lower lateral wall portions 28*b*. The upper lateral wall portions 28*a* may be separated from one another by a distance about equal to the narrower width 22 of the curved upper surface 16. The lower lateral wall portions 28*b* are separated from one another by a distance about equal to the width 20 of the flat lower surface. The distance 30 between the grooves 14 is preferably less than the narrower width 22 and the width 20. The lateral wall portions 28*a*, 28*b* are straight in the illustrated embodiment such that sharp corners are formed at the junction of the lateral wall portions 28*a*, 28*b* with the curved upper surface 16 and flat lower surface 18, respectively.

The curved upper surface 16 and flat lower surface 18 are preferably of equal hardness. For example, the sanding block 10 may be formed monolithically of a single piece of material, such as a polymer. The sanding block 10 is preferably formed of a material that is firm enough to enable a user to apply pressure along a substantial portion of the curved upper surface 16 or flat lower surface 18 when sanding. However, the material is also preferably flexible enough to allow the sanding block to bend along its longitudinal direction 12 in order to conform to curved structures. Materials having a Shore A hardness ranging from about 45 to about 90 have been found to provide such functionality. In a preferred embodiment, the sanding block 10 is formed of a polymer.

Figure 3A:
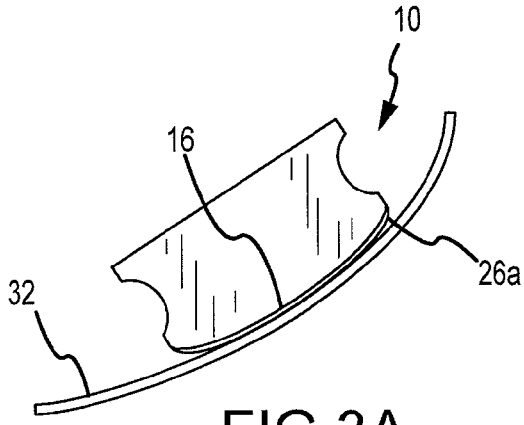
FIG. 3A is a front view illustrating a sanding block in accordance with an embodiment of the present invention sanding a concave surface.
Figure 3B:
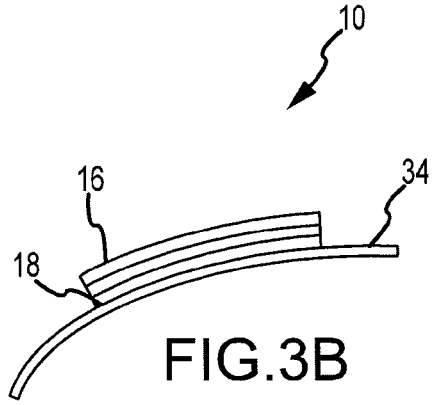
FIG. 3B is a side view illustrating use of a sanding block in accordance with an embodiment of the present invention sanding a convex surface.

Referring to FIG. 3A, the curved upper surface 16 facilitates sanding of concave surfaces 32 having small radii of curvature. For example, the curved upper surface 16 may be used to sand surfaces having radii of curvature to which the sanding block can not easily be bent to conform. The sanding block 10 may also be bent such that it may be used to sand surfaces that are convex in one direction but concave in another. Referring to FIG. 3B, the flat lower surface 18 is suitable for convex and concave surfaces 34 having larger radii of curvature through bending of the sanding block 10 along the longitudinal direction 12 as shown. The lower surface 18 may also be used for planar surfaces.

While the sanding block of the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. A method for sanding surfaces comprising:

adhering a first sheet of sandpaper having a rectangular shape defined by a width to a flat lower surface of a sanding block having a curved upper surface; and adhering a second sheet of sandpaper to the curved upper surface, the second sheet having a rectangular shape having a width equal to the respective width of the first sheet, the curved upper surface of the sanding block having a first width and having a first distance across the curved upper surface, the flat lower surface of the sanding block having a second width, the first width being narrower than the second width and the first distance across the curved upper surface substantially equal to a second distance across the flat lower surface.

2. The method of claim 1, wherein the curved upper surface is opposite the flat lower surface.

3. The method of claim 1, wherein the curved upper surface has an arc length about equal to a width of the flat lower surface.

4. The method of claim 3, wherein the arc length of the curved upper surface and the width of the flat lower surface are substantially equal to the widths of the first and second sheets.

5. The method of claim 1, wherein the first and second sheets extend to proximate the edges of the curved upper surface and flat lower surface.

6. The method of claim 1, further comprising:

sanding at least one of a flat and convex surface with the first sheet of sandpaper adhered to the flat lower surface; and sanding a concave surface with the second sheet of sandpaper adhered to the curved upper surface.

7. The method of claim 6 further comprising bending the sanding block along the longitudinal axis to conform to the convex and concave surfaces.

8. The method of claim 6, wherein the concave surface is concave in a first plane and convex in a second plane orthogonal to the first plane, the method further comprising:

orienting the sanding block having the longitudinal axis in a plane parallel to the second plane and having the curved upper surface facing the concave surface;

bending the sanding block to conform the sanding block to the convexity of the concave surface in the second plane; and sanding the concave surface.

9. A sanding assembly comprising:

a sanding block having a curved upper surface and a flat lower surface opposite the curved upper surface, the curved upper surface having a first width and having a first distance across the curved upper surface, the flat lower surface having a second width, the first width being narrower than the second width and the first distance across the curved upper surface substantially equal to a second distance across the flat lower surface; and the curved upper surface configured to receive a first sheet of sandpaper to substantially covers the curved upper surface, and the flat lower surface configured to receive a second sheet of sandpaper to substantially covers the flat lower surface, the first sheet of sandpaper and the second sheet of sandpaper having widths about equal to that of the flat lower portion.

10. The sanding assembly of claim 9, wherein the first and second sheets of sandpaper have a width of approximately 2.75 inches.

11. The sanding assembly of claim 9, wherein the curved upper surface has a hardness equal that of the flat lower surface.

12. The sanding assembly of claim 11, wherein the curved upper surface and flat lower surface have a Shore A hardness of between 45 and 90.

13. The sanding assembly of claim 11, wherein the sanding block is formed from a flexible material.

14. The sanding assembly of claim 9, wherein opposing edges of the sandpaper are adjacent opposing edges of the at least one of the curved upper surface and flat lower surface to which it is secured.

15. The sanding assembly of claim 9, wherein a line bisecting both the curved upper surface and flat lower surface is perpendicular to both the curved upper surface and flat lower surface at a point of intersection on both the curved upper surface and flat lower surface.

16. The sanding assembly of claim 9, wherein the sanding block includes a longitudinal recess extending along a lateral surface positioned between the flat lower surface and the curved upper surface.

17. The sanding assembly of claim 9, wherein the curved upper surface has a varying radius of curvature.

18. The sanding assembly of claim 17, wherein the sanding block has a longitudinal axis positioned substantially in the center of the sanding block and a radius of curvature of the curved upper surface decreases with distance from the longitudinal axis.

19. The sanding assembly of claim 18, wherein the radius of curvature continuously decreases with distance from the longitudinal axis.

* * * * *